United States Patent [19]

Murahashi

[11] Patent Number: 4,601,335

[45] Date of Patent: Jul. 22, 1986

[54] WELL DEVICE

[75] Inventor: Yoshio Murahashi, Kokubunji, Japan

[73] Assignee: Asia Suigen Co., Ltd., Japan

[21] Appl. No.: 642,217

[22] Filed: Aug. 20, 1984

[30] Foreign Application Priority Data

Dec. 5, 1983 [JP] Japan ..... 58-228474

[51] Int. Cl.[4] ..... E21B 43/00

[52] U.S. Cl. ..... 166/242; 166/50

[58] Field of Search ..... 166/242, 50, 369, 227; 73/155

[56] References Cited

U.S. PATENT DOCUMENTS 1,613,105 1/1927 Helm ..... 166/242

2,622,683 12/1952 Silitch et al. ..... 166/50 X 2,740,476 4/1956 D'Audiffret et al. ..... 166/50 X 3,187,567 6/1986 O'Bien et al. ..... 73/155

*Primary Examiner*—Stephen J. Novosad

*Assistant Examiner*—Thuy M. Bui

*Attorney, Agent, or Firm*—Armstrong, Nikaido, Marmelstein & Kubovcik

[57] ABSTRACT

A well device comprising a vertially installed suction pipe and a plurality of horizontal water collecting pipes horizontally provided in a water layer, the horizontal water collecting pipes being provided with a number of water collecting holes. With this construction, a sufficiently large area of water collecting holes may be obtained and a flow speed of groundwater is reduced and therefore, a loss of well does not occur, entry of earth and sand is prevented, dewatering of the water layer is restricted, and durable years of well may be considerably increased.

4 Claims, 9 Drawing Figures

WELL DEVICE

BACKGROUND OF THE INVENTION

1. Field of the Invention

The present invention relates to a water well device.

2. Description of the Prior Art

A water well is basically constructed such that a space is formed in a water stratum, and groundwater is collected into the space and pumped up.

Hydrographically, the ideal form is the 'dig and leave' construction. That is, well walls are left to be a natural water layer, and no barrier is provided so that groundwater freely flows into the well in a natural state.

However, in the 'dig and leave' condition, the well walls are soon broken down, and therefore, stones are compelled to be stacked. Or, pipes A such as concrete pipes, iron pipes, plastic pipes or the like are incorporated to form protective walls as shown in FIG. 1 so that groundwater may flow into the well through the protective walls. Therefore, open portions B, B . . . obtained by the provision of holes, slits and screen need be provided. However, the percentage of open area of these open portions B, B . . . to well wall surfaces, that is, the open percentage is less than 35% at the most.

Accordingly, in conventional water wells, particularly, pipe wells, it is designed so that the open portions B, B . . . are provided only in the peripheral surfaces of the protective walls. For this reason, a water collecting area required for flow-in of groundwater is excessively small. This brings forth (1) increase in well loss, (2) densification of the water layer about the well, (3) occurrence of jamming of the open portions, and (4) flow-in of earth and sand, etc.

Due to the aforesaid (1) increase in well loss, power consumption for drawing water increases; due to the aforesaid (2) and (3) densification in water layer and jamming, durable years of a well are shortened; and due to the aforesaid (4) flow-in of earth and sand, pumping-up equipment such as pumping-up pumps, screens and the like are worn and damaged.

There poses problems in maintenance induced from the aforementioned factors, in that installation of a device for settling and filtering earth and sand and management cost are necessary, a periodical cost of cleaning the interior of a well is required, and a great loss is brought forth in that with a loss due to the stoppage of pumping-up operation, the synthetic service life of the well is further shortened.

Various defects of the above-described well device will be discussed. First, a water collecting area is absolutely short. Secondly, water collection is achieved by the flowing-in only in a horizontal direction refracted by 90° despite the fact that a descent of groundwater at the time of pumping-up acts in a direction of gravity, and therefore, the resistance increases. Thirdly, since the water collecting area is small, inlet velocity of groundwater extremely increases, as a consequence of which a discontinuity (loss of well) occurs between groundwater and a leaching surface, inviting entry of earth and sand. In addition, in the conventional well, a part of open portions of the well walls is exposed to an upper surface of a water level, and therefore, jamming is accelerated by break down of the stratum due to drying resulting from contact of said part with air, corrosion due to oxidizing action, generation of scale and the like, thus shortening durable years. Pumping power cost is wastefully consumed due to the lowering of water level by a loss portion of well.

SUMMARY OF THE INVENTION

In view of the foregoing, in the present invention, a conventional water collecting means using open portions into which water flows horizontally into the well from the groundwater layer is radically modified. It is an object of the invention to provide a well device in which a plurality of horizontal water collecting pipes are provided horizontally in a water layer in a vertically installed suction pipe, and a number of water collecting holes are provided in the horizontal water collecting pipes, and water naturally flowing into a well is collected vertically, to thereby overcome various problems with respect to prior arts.

DETAILED DESCRIPTION OF THE PREFERRED EMBODIMENTS

Figure 1:
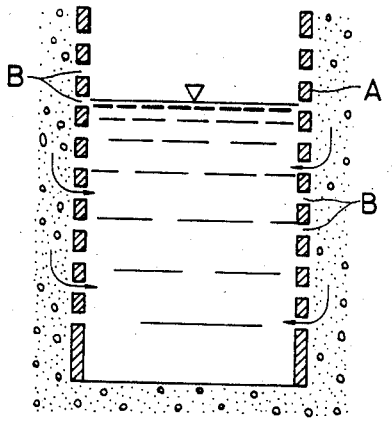
FIG. 1 is a partial longitudinal sectional view showing a construction of open portions of well walls in a conventional well.
Figure 3:
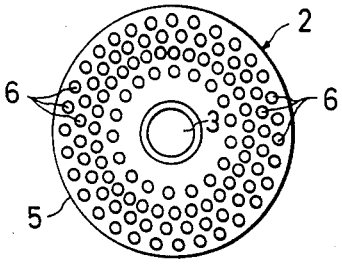
FIG. 3 is a plan view of the same.

In the following, the present invention will be described while referring to embodiments shown in FIGS. 2 to 8.

A well device in accordance with the present invention is provided with a water collecting and suction pipe 2 vertically inserted and installed within a dig and leave well hole 1, the pipe 2 comprising a suction pipe 3 vertically installed and a plurality of horizontal water collecting pipes 5, 5 . . . positioned within a water layer 4.

Figure 2:
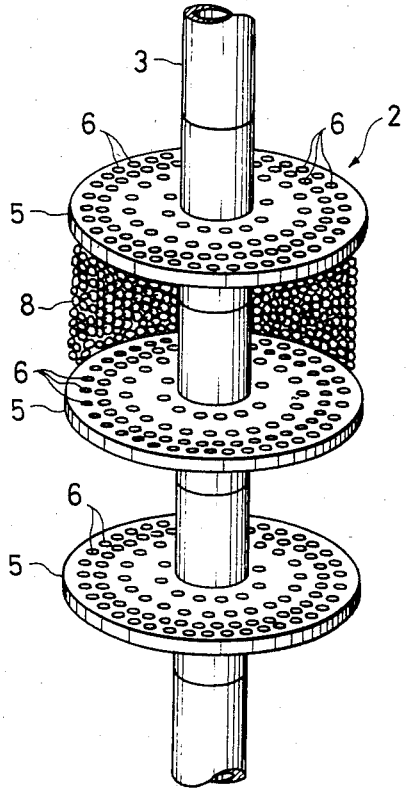
FIG. 2 is a partial perspective view showing one example of a water collecting and suction pipe used for a well device in accordance with the present invention.
Figure 4:
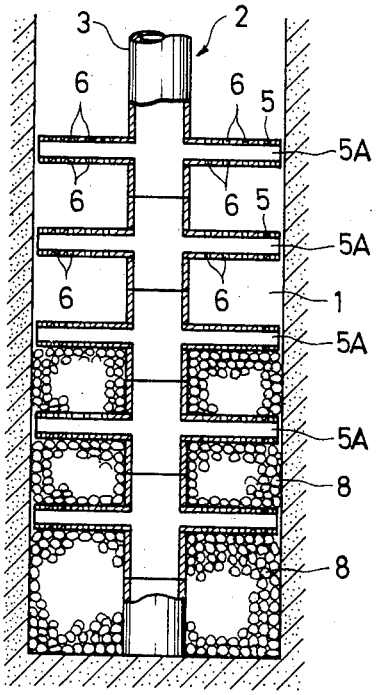
FIG. 4 is a longitudinal sectional view showing the installation of elements inserted into a well hole.

One embodiment of the horizontal water collecting pipe 5 is shown in FIG. 2, and the pipe 5 is composed of a disc-like member having an outside diameter capable of being fitted in the inner peripheral surface of the well hole 1 as close as possible and having a space 5A therein. A number of water collecting holes 6, 6 . . . are vertically bored in upper and lower surfaces of the disc-like member, The aforesaid internal space 5A is brought into communication with the interior of the central suction pipe 3. The horizontal water collecting pipes 5, 5 . . . are vertically mounted on the suction pipe 3 in spaced relation.

Figure 6:
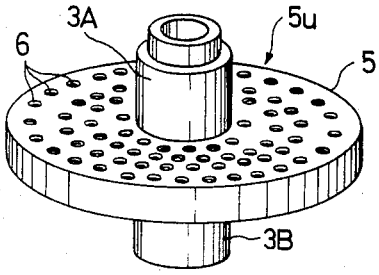
FIGS. 6 and 7 are perspective views showing one example in case where horizontal water collecting pipes of a water collecting and suction pipe are formed into a unit.

In a specific construction of the water collecting and suction pipe 2 shown in FIG. 6 as one embodiment, a number of horizontal water collecting pipe units 5U with joint pipes 3A, 3B projected are formed in the center of the water collecting and section pipe 5, one end of the joint pipes 3A, 3B is formed into a convex shape while the other end being formed into a concave shape, so that the concave and convex portions of the joint pipes 3A, 3B of the units 5U, 5U . . . are fitted to thereby form a series of suction pipes 3.

The water collecting holes 6, 6 . . . are arranged so that they are formed coarsely at a position close to the suction pipe 3 whereas they are formed densely at a position away therefrom.

Figure 5:
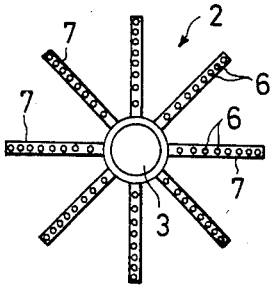
FIG. 5 is a plan view showing a modified form of a water collecting and suction pipe.
Figure 7:
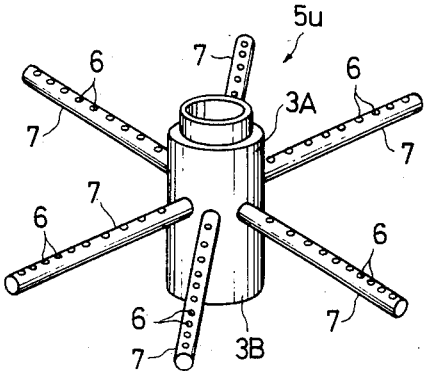

While in the above-described embodiment, the horizontal water collecting pipe 5 has been formed into a disc-like member, it will be noted that as shown in FIG. 5 in which it has a plan shape and as shown in FIG. 7 in which it is formed into a unit, pipe members 7, 7 . . . are radially projected in the outer periphery of the suction pipe 3 and communicated with the interior of the suction pipe 3, and vertical water collecting holes 6, 6 . . . are bored in the pipe members 7, 7 . . . These water collecting holes 6, 6 . . . are also arranged coarsely at a portion of root thereof and densely at a portion towards the fore end.

The thus constructed water collecting and suction pipe 2 is inserted into the well hole 1, and gravel 8 is filled between upper and lower portions of the horizontal water collecting pipes 5, 5 . . . to protect well walls.

Thereby, groundwater coming from the inner wall surfaces of the well hole 1 flows into the well hole 1 and is maintained at a predetermined water level L.

When groundwater is pumped up through the suction pipe 3, the groundwater passes through the layer of gravel 8, flows therein from the vertical water collecting holes 6, 6 . . . of the horizontal water collecting pipes 5, 5 . . . and is pumped up through the section pipe 3.

Figure 8:
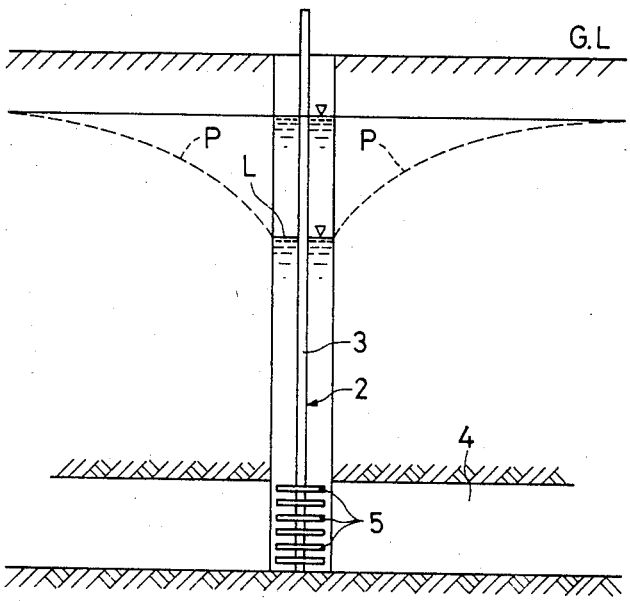
FIG. 8 is an explanatory view of installation of a well device in accordance with the present invention.
Figure 9:
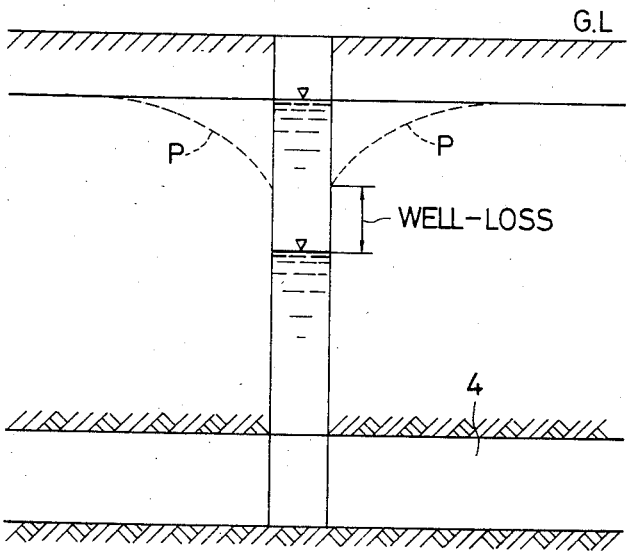
FIG. 9 is an explanatory view showing the state a well loss of a conventional well.

A basic difference between the conventional well and the well using the water collecting and suction pipe 2 in accordance with the present invention is that as in FIG. 8 which shows the present invention and as in FIG. 9 which shows the conventional well, in the conventional well the water level descent curves P, P at the time of pumping-up are discontinuous in level between the outside (water layer side) and the inside of the well wall or well region, necessarily producing so-called well loss, whereas in the well of the present invention, the curves are continuous for both inside and outside, producing no well loss.

The causes for generation of the above-described well loss will be discussed. Its greatest cause is the "short of an area of water collecting hole to estimated intake".

In accordance with Darcy's equation, which comprises a foundation of intake theory, the following is given:

$$Q = V \cdot A$$
$$= K \cdot I \cdot A$$

where

Q: estimated intake
V: flow velocity
A: area of water collecting hole
K: coefficient of permeation
I: gradient of moving water Since the relation of $I \leqq 1$ is established, the minimal value of area of water collecting hole is given by:

$$Q = K \cdot A \therefore A = Q/K$$

If the relation between the coefficient of permeation of the water layer at that place and the flow velocity of groundwater is considered to be the coefficient of permeation (K)×gradient of moving water (I) (maximum 1)=flow velocity (maximum flow velocity), the required area of water collecting hole with respect to the estimated intake has to be given by:

$$\text{Area of water collecting hole} \geqq \text{estimated intake} \div \text{coefficient of permeation} \times 1.$$

In other words, the flow velocity of groundwater in the water collecting portion is normally coefficient of permeation×1 or less, and therefore, the area of water collecting hole has to be increased accordingly. The short of the area of water collecting hole invites the loss of well and local increase in flow velocity.

In accordance with the present invention, let $a_o$ be the area of water collecting hole, then $$Q = K \cdot \Sigma a_o \therefore \Sigma a_o = Q/K$$

the water collecting holes can be freely increased by the water collecting pipe unit 5U to secure a sufficient $\Sigma a_o$. Therefore, the flow velocity of groundwater can be held to be sufficiently low to prevent occurrence of well loss.

As described above, the well device of the present invention is designed so that groundwater, which is once flown into and stayed in the water layer within the well hole, is drawn from the suction pipe through the horizontal water collecting pipe. Thereby a sufficient area of water collecting hole is secured and the flowing direction of groundwater in the water collecting holes of the horizontal water collecting pipe is vertical to reduce a resistance of water flowing into the well device. Even if the suction speed should be increased, an increase in flow speed resulting therefrom is made small through a portion in which the area of water collecting hole is large to make it difficult to produce entry of earth and sand. In addition, densification due to dewatering of the water layer about the well does not occur to thereby considerably extend durable years of well.

Moreover, installation of the settling and filtering device for earth and sand, management, periodical cleaning and stoppage of operation for that purpose are not necessary, and various conventional problems in maintenance can simultaneously be overcome.

What is claimed is:

1. Well apparatus which comprises:

a well bore containing a central suction pipe and means for pumping water through said suction pipe out of the well bore;

a predetermined plurality of water collecting units disposed in said well bore secured to said suction pipe at spaced intervals therealong said suction pipe beginning at the bottom of said bore in ground water layer of the bore;

each of said units having horizontal portions extending outwardly from said suction pipe to a region adjacent the exterior of said bore with vertically disposed intake openings to allow water to flow through said horizontal portions into said suction pipe;

the total area of said intake openings being sufficient to provide a reduced flow speed of ground water and prevent breakdowns of the water bearing strata and discontinuity of the well.

2. The well device according to claim 1, wherein said horizontal water collecting pipe comprises a hollow disc-like member.

3. The well device according to claim 1, wherein said horizontal water collecting pipe comprises a radial pipe member.

4. The well device according to claim 1, wherein said water collecting holes are bored coarsely at a part close to the suction pipe and bored densely at a part away therefrom.

* * * * *